US007701423B2

(12) United States Patent
Suwabe et al.

(10) Patent No.: US 7,701,423 B2
(45) Date of Patent: Apr. 20, 2010

(54) IMAGE DISPLAY DEVICE AND METHOD

(75) Inventors: Yasufumi Suwabe, Ashigarakami-gun (JP); Yoshiro Yamaguchi, Ashigarakami-gun (JP); Yoshinori Machida, Ashigarakami-gun (JP); Motohiko Sakamaki, Ashigarakami-gun (JP); Atsushi Hirano, Ashigarakami-gun (JP); Takeshi Matsunaga, Ashigarakami-gun (JP); Kiyoshi Shigehiro, Ashigarakami-gun (JP); Shunichiro Shishikura, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1048 days.

(21) Appl. No.: 11/399,489

(22) Filed: Apr. 7, 2006

(65) Prior Publication Data

US 2007/0046621 A1 Mar. 1, 2007

(30) Foreign Application Priority Data

Aug. 23, 2005 (JP) ..... 2005-241105

(51) Int. Cl.
*G09G 3/34* (2006.01)

(52) U.S. Cl. ..... 345/85; 345/84; 345/107

(58) Field of Classification Search ..... 345/84, 345/107, 108, 85; 359/296–302
See application file for complete search history.

(56) References Cited

U.S. PATENT DOCUMENTS

| | | | | |
|---|---|---|---|---|
| 6,149,480 | A * | 11/2000 | Iwasaki et al. | 445/6 |
| 6,753,844 | B2 * | 6/2004 | Machida et al. | 345/107 |
| 2002/0196219 | A1 * | 12/2002 | Matsunaga et al. | 345/87 |
| 2004/0051934 | A1 * | 3/2004 | Machida et al. | 359/296 |
| 2004/0155858 | A1 * | 8/2004 | Hiraoka et al. | 345/107 |
| 2006/0238488 | A1 * | 10/2006 | Nihei et al. | 345/107 |

FOREIGN PATENT DOCUMENTS

| | | |
|---|---|---|
| JP | A-09-006277 | 1/1997 |
| JP | A-2004-004483 | 1/2004 |

* cited by examiner

*Primary Examiner*—Richard Hjerpe
*Assistant Examiner*—Sahlu Okebato
(74) *Attorney, Agent, or Firm*—Oliff & Berridge, PLC

(57) ABSTRACT

An image display device and image display method are provided. The device and method can prevent changes in image density and contrast, which are caused by repeated displaying over long periods of time and changes in environment, by employing accurate electric current detection, due to the following operations. Voltage measurement is initiated with a detection circuit. Next, the application of drive voltage is initiated with a drive power source. An electric current value is calculated from the measured voltage value and the electric current value is temporarily stored. The electric current values are stored every set amount of time and the storage thereof accumulates. Application of the drive voltage is terminated and the integral value of the electric current is calculated in accordance with formulas.

11 Claims, 15 Drawing Sheets

IMAGE DISPLAY DEVICE AND METHOD

CROSS-REFERENCE TO RELATED APPLICATION

This application claims priority under 35 USC 119 from Japanese Patent Application No. 2005-241105, the disclosure of which is incorporated by reference herein.

BACKGROUND OF THE INVENTION

Technical Field

The present invention relates to an image display device and an image display method used therein. Specifically, the present invention relates to an image display device that has a pair of electrodes, at least one of which is a transparent electrode, between which predetermined image display voltage is applied based on image data, whereby color particles enclosed between the electrodes are made to move and an image is displayed at the side of the transparent electrode(s). The present invention also relates to an image display method used in this device.

Conventional image display devices have been proposed where two substrates, at least one of which is translucent, face each other with a predetermined space set between them. Between these substrates, colored particles (e.g., black) are enclosed and predetermined image display voltage is applied thereto, whereby the particles between the substrates move and an image is displayed. Image display devices configured in this manner are known to have problems with display function deterioration, such as degradation of the contrast of the displayed image due to prolonged use (e.g., with the switch-over operation of the display screen).

Here, in order to prevent deterioration of the display function, measures have been taken such as setting the voltage application time to be longer, or increasing the value of the voltage itself. Nonetheless, extending the voltage application time longer than necessary or increasing the voltage contributes to the deterioration of the structural components, so these measures have been problematic in that they degrade the life of the image display device.

In response to this problem, technologies have been proposed where the movement time of the particles sealed between the substrates forming the image display device is measured, and the voltage application time is controlled based on these measurement results (e.g., see the Official Gazette of Japanese Patent Application Laid-Open (JP-A) No. 9-6277). Slowing the movement time directly influences deterioration of contrast, so corrections in which the movement time is made the parameter are an effective means of dealing with this problem.

Other technologies have been proposed where two different types of particles having differing charge polarities are enclosed between the substrates, and voltage is applied to the particles so as to make them move between the substrates. Due to this, rectangular voltage waves (i.e., rhomboidal waves) at or below the threshold that causes particle movement are applied in the device, the electric current between the substrates is detected, and the voltage applied between the substrates is adjusted (e.g., see the Official Gazette of JP-A No. 2004-4483). The electric current flowing between the substrates (i.e., electrodes) is channeled in accordance with the movement of the particles so the movement can be controlled with the integral value of this electric current.

In this manner, control and detection of display function degradation, such as contrast deterioration, is performed.

Nonetheless, with the above-described technologies, the voltage applied between the substrates is applied in rectangular waveform and the start time is close to substantially zero, so incoming current is generated at the electric current channeled at resetting. It is thus necessary to set a measurement peak due to this incoming current and as a result, it has been necessary to expand the range of electric current measurement (i.e., the dynamic range).

It should be noted that in comparison with the electric current that flows with the movement of the particles, this dynamic range is extremely large. For this reason, it becomes difficult to accurately detect minute changes (i.e., deterioration due to repeated displaying over long periods of time and changes in environment such as temperature, moisture, and pressure) in the electric currents that accompany particle movement. That is, only a portion of the dynamic range can be applied. Accordingly, it has become difficult to achieve a solution where degradation of the display function can be detected with good accuracy, and good contrast adjustment can thus not be achieved.

Furthermore, incoming current is inherently problematic in that it places a burden on the power source.

SUMMARY OF THE INVENTION

In light of the above-described circumstances, the present invention provides an image display device that can prevent changes in the image density and contrast due to deterioration caused by repeated displaying over long periods of time and changes in environment (e.g., temperature, moisture, and atmospheric pressure) by employing accurate electric current detection. The present invention also provides an image display method to be used in this image display device.

Further, the present invention provides an image display device and method by which the burden placed on the power source can be reduced.

A first aspect of invention is an image display device comprising colored particles enclosed between a pair of electrodes, at least one of which is a transparent electrode. The image display device moves the colored particles by applying predetermined image display voltage based on image data and displaying an image at the transparent electrode side. The image display device includes a test voltage application unit that applies test voltage set to be at least greater than the image display voltage; a detection unit that detects the physical amount of electricity between the pair of electrodes when the test voltage is applied with the test voltage application unit, and a determination unit that judges the status of the image display voltage for displaying an image based on the detection result of the detection unit. A predetermined start time is set at the test voltage by the test voltage application unit.

A second aspect of invention is an image display method for an image display device that comprises colored particles enclosed between a pair of electrodes, at least one of which is a transparent electrode, the image display device moving the colored particles by applying predetermined image display voltage based on image data and displaying an image at the transparent electrode side. The image display method includes applying preliminary test voltage that moves the colored particles towards at least one of the electrodes, applying a first test voltage that moves the colored particles moving towards one electrode to the other electrode, and applying a second test voltage that maintains the colored particles moved toward the other electrode, and calculating the difference between the physical amount of electricity between the pair of electrodes when the first test voltage is applied and the physical amount of electricity between the pair of electrodes when the second test voltage is applied. A judgment is made on the status of the image display voltage for displaying an image based on the calculation result.

BRIEF DESCRIPTION OF THE DRAWINGS

The present invention will be described while referring to the following drawings where.

DETAILED DESCRIPTION OF THE INVENTION

First Embodiment

Figure 1:
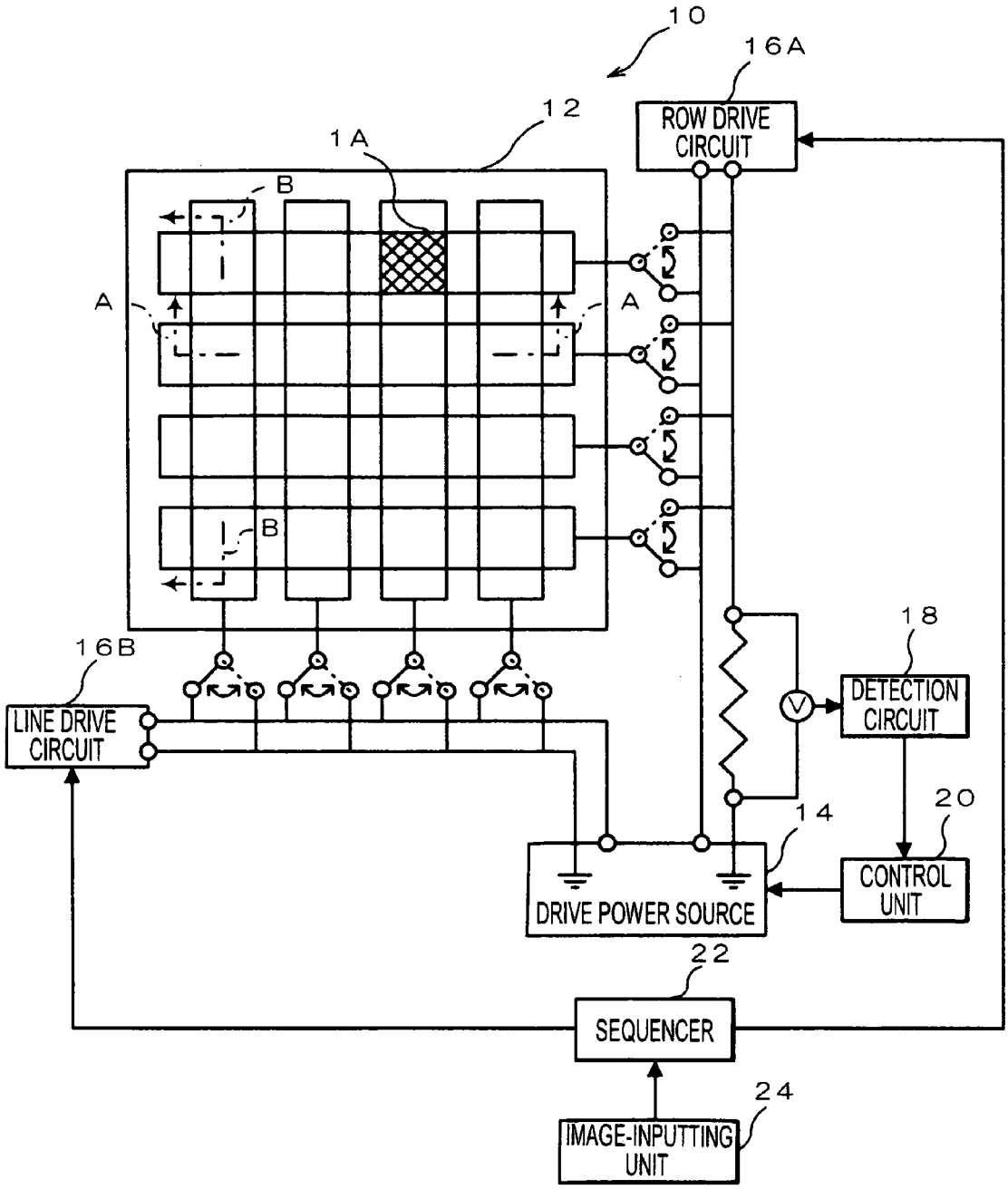
FIG. 1 is an explanatory diagram of the image display device according to the first embodiment.

FIGS. 1-3 show an image display medium 12 according to the first embodiment.

As shown in FIG. 1, an image display device 10 is provided with an image display medium 12 and drive circuits 16A, 16B that drive the image display medium 12.

The image display medium 12 is connected to the drive circuits 16A, 16B. Specifically, line electrodes 30B of a display substrate 26 and row substrates 30A of a back substrate 28 are respectively connected to the line drive circuit 16B and the row drive circuit 16A. The line drive circuit 16B and the row drive circuit 16A are connected to a sequencer 22 and a drive power source 14.

The sequencer 22 is connected to an image-inputting unit 24 and outputs image data signals to the line drive circuit 16B and the row drive circuit 16A in accordance with arbitrary image data inputted from the image-inputting unit 24. The sequencer 22 is also designed to control the timing of voltage application.

The image display device 10 is further provided with a detection circuit 18 that detects electric current flowing from the drive power source 14, and also with a control unit 20 that executes control of the voltage applied to each of the display pixels based on the detected electric current.

The image display medium 12 according to the first embodiment is driven by a simple matrix drive system. Theoretically, an active matrix drive system can also be applied to the present invention, however, the explanations below will be made with regard to a simple matrix drive system.

Figure 3A:
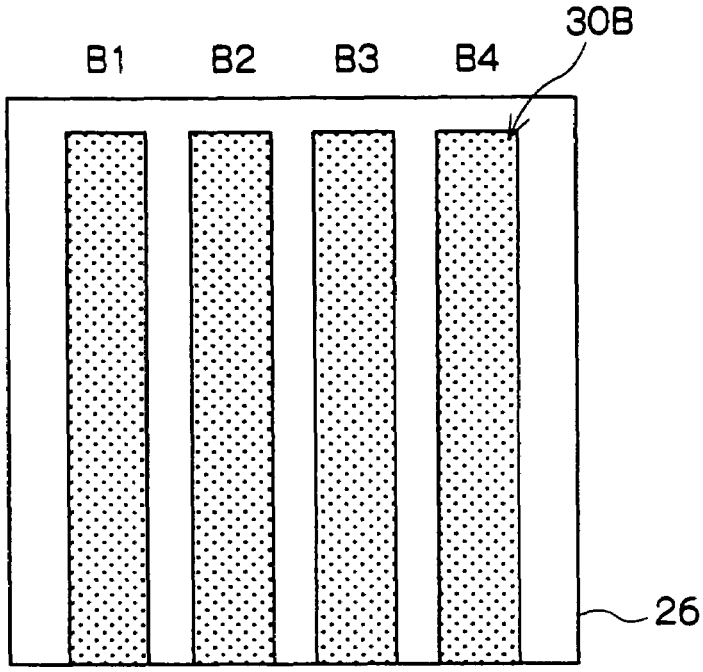
FIG. 3A is a cross-sectional drawing of the A-A portion of FIG. 1.
Figure 3B:
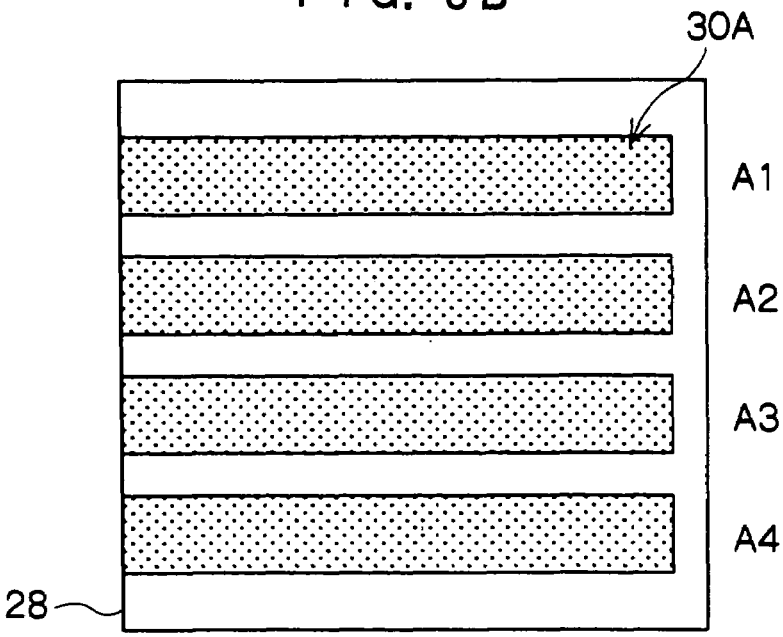
FIG. 3B is a cross-sectional drawing of the B-B portion of FIG. 1.

As shown in FIG. 3A, multiple line-shaped electrodes 30B (hereafter, "line electrodes") are provided at the surface facing the back substrate 28 of the display substrate 26. Similarly, as shown in FIG. 3B, multiple line-shaped electrodes 30A (hereafter, "row electrodes") are also provided at the surface facing the back substrate 28 of the display substrate 26. The display substrate 26 and the back substrate 28 are arranged to face each other so that the line electrodes 30B and row electrodes 30A provided thereon intersect each other. The display substrate 26 is transparent.

It should be noted here that with a simple matrix drive, image writing signals (i.e., scanning signals) for each row are sent from the sequencer 22 to the row drive circuit 16A, and image writing voltage from the row drive circuit 16A is sequentially applied to the row electrodes 30A of the back substrate 28. At the same time, image data signals corresponding to the rows to which image writing voltage is applied are sent from the sequencer 22 to the line drive circuit 16B, corresponding to the image writing voltage sequentially applied to the row electrodes 30A of the back substrate 28. The image writing voltage corresponding to the writing rows from the line drive circuit 16B to the line electrodes 30B of the display substrate 26 is applied concurrently. This is sequentially performed from the first row to the last row so that the desired image is displayed.

Further, particles having different charging properties from each other are enclosed between the display substrate 26 and the back substrate 28. These particles are positively charged black particles 32 and negatively charged white particles 34.

Figure 2A:
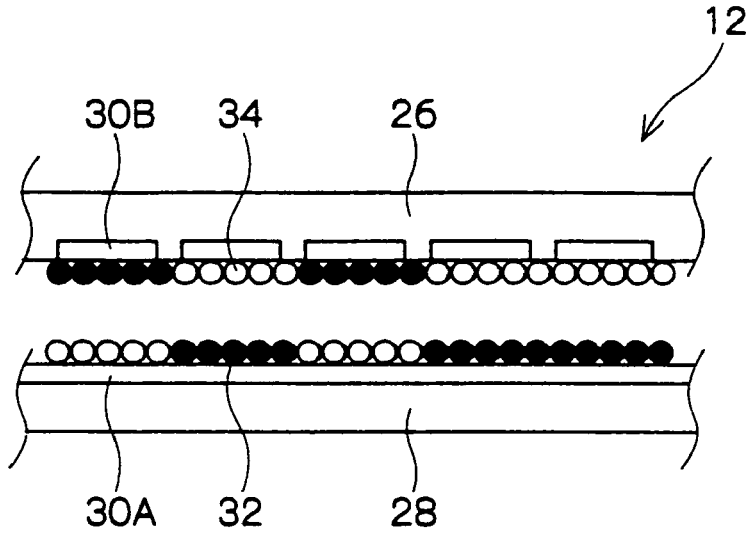
FIG. 2A is a frontal diagram of a display substrate of the image display medium according to the first embodiment.
Figure 2B:
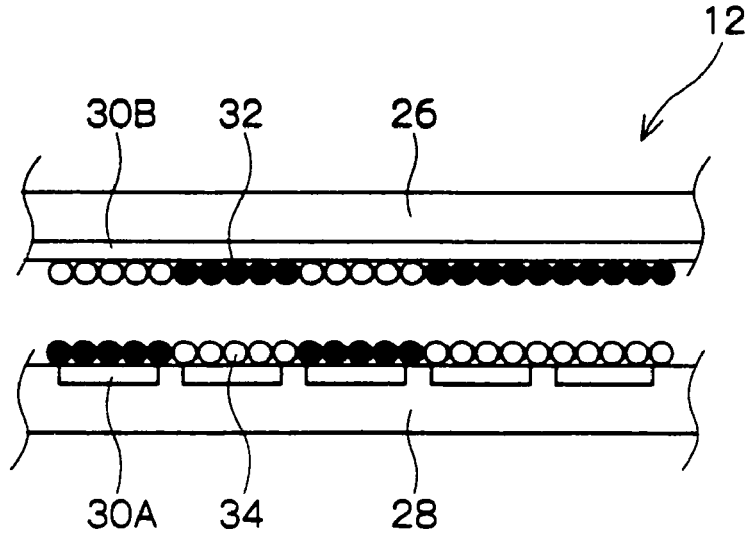
FIG. 2B is a frontal diagram of a back screen substrate of the image display medium according to the first embodiment.

The component shown in FIG. 2A is a cross-sectional view of the portions indicated with the A-A lines in FIG. 1, and the component shown in FIG. 2B is a cross-sectional view of the portions indicated with the B-B lines in FIG. 1.

It should be noted that with the first embodiment, for the sake of simplifying the explanations, the simple matrix configuration is 4×4, and the four lines of line electrodes 30B of the display substrate 26 are respectively labeled B1, B2, B3, and B4. The rows of electrodes of the back substrate 28 are row electrodes 30A respectively labeled A1, A2, A3, and A4. Needless to say, the number of electrodes formed at each substrate in actual practice is determined in accordance with the number of vertical and horizontal pixels necessary for displaying an image. Also, with the first embodiment, the device was configured so as to form line-shaped electrodes of the display substrate 26 into lines of electrodes and the line-shaped electrodes of the back substrate 28 into rows of electrodes. Nonetheless, the device can have an opposite configuration where the rows of electrodes are provided at the display substrate 26 and the lines of electrodes are provided at the back substrate 28.

Next, the functional structure of the image display medium 12 according to the first embodiment will be explained using FIG. 4.

The drive power source 14 is configured to include an image display voltage application unit 36, a drive parameter-setting unit 38, a detection voltage application unit 40, and a drive parameter changing unit 42. The image display voltage application unit 36 applies image display voltage in order to make an image display on the image display medium 12. The drive parameter-setting unit 38 sets the drive parameters that control the driving of the image display voltage application unit 36. The detection voltage application unit 40 applies test voltage for testing the display capabilities of the image display medium 12. Finally, the drive parameter changing unit 42 changes the drive parameters from the test results based on the test voltage applied by the detection voltage application unit 40. It should be noted that the image display voltage application unit 36 and the detection voltage application unit 40 are controlled by a voltage application control means (not shown) that acts as the main control component of the drive power source 14.

The process of applying voltage to the image display with the image display voltage application unit 36 will be explained.

The image display voltage application unit 36 has two voltage application modes, namely, a voltage application mode for initializing or resetting the entire screen, and a mode for applying voltage to an image display in accordance with image data.

With the configuration of the first embodiment, the particles generate static electricity, which they themselves possess, and force (i.e., adhesion force) that adheres them to the surface of the display substrate 26 or back substrate 28 due to force between the molecules such as van der Waals force, so even if voltage is applied between the display substrate 26 and back substrate 28, the particles do not move to a certain strength of electrical field (due to the application of threshold voltage). The strength of the electrical field also depends on the distance between the display substrate 26 and back substrate 28, however, this can be controlled with the amount of voltage applied thereto. (Note: The term threshold voltage used here refers to the voltage that initiates movement of the black particles 32 or white particles 34, adhered to the surface of the row electrodes 30A or the line electrodes 30B, to the display substrate 26 or back substrate 28 side.)

Figure 5A:
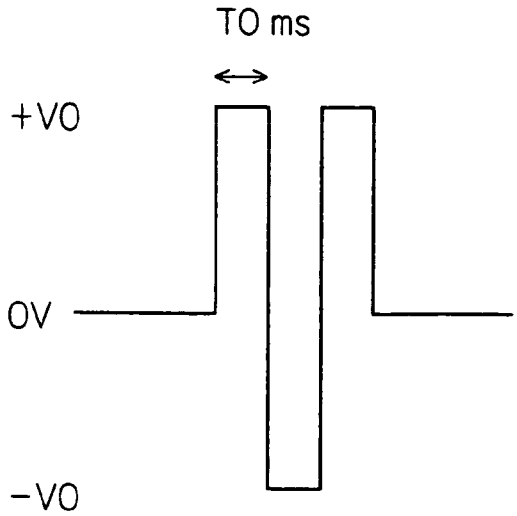
FIG. 5A is the substrate electric potential of the surface electrodes in the resetting mode.
Figure 5B:
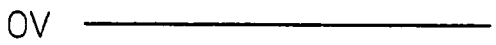
FIG. 5B is the substrate electric potential of the back screen electrodes in the resetting mode.

The voltage for resetting, performed in a regular state (i.e., the state of resetting during shipment of the device) where display deterioration has not occurred is, as shown in FIGS. 5A and B, applied to the line electrodes 30B at the side of the display substrate 26 at between one to several pulses of ±V0 (V), T0 (ms), where the back surface electrodes are made to have grand electric potential. The device is designed such that a polarity is set so that at the display substrate 26 side a state is achieved where the entire screen is covered with white particles and reset (i.e., the entire screen becomes a white display).

Figure 5C:
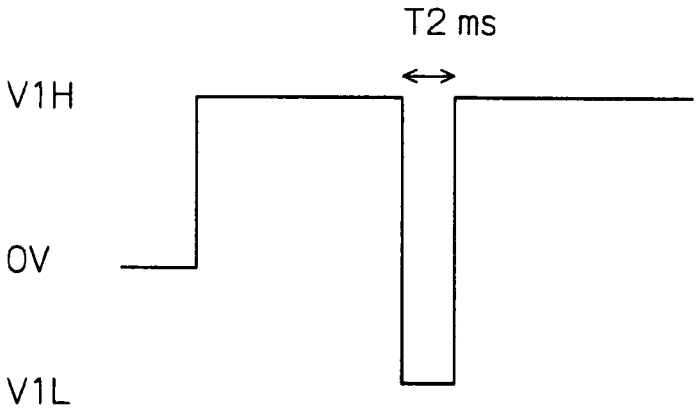
FIG. 5C is the substrate electric potential of the surface electrodes in the writing mode.
Figure 5D:
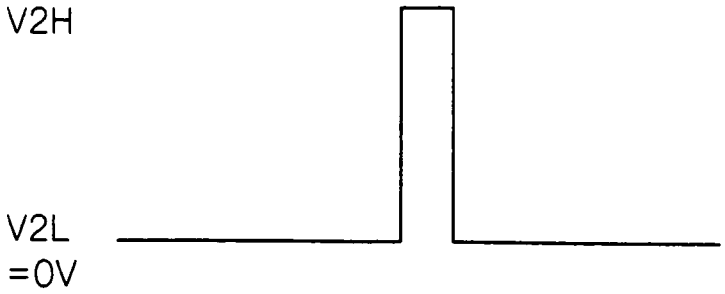
FIG. 5D is the substrate electric potential of the back screen electrodes.

Image display voltage is applied when an image is displayed, however, as shown in FIGS. 5C and 5D, the system is designed so that V1H (V) is set to all line electrodes 30B at the display substrate 26 side (i.e., the side to which image data is applied) and V2L (V) is set to the row electrodes 30A at the back substrate 28 side in a state where application is initiated. In this state, the voltage between the display substrate 26 and back substrate 28 sides is equal to or less than a threshold voltage VT (V), as seen in the following Formula 1, so the particles do not move.

$$|V1H-V2L| \leqq VT \qquad \text{Formula 1:}$$

Further, even if the relation is such as shown in the following Formulae 2 and 3, the particles do not move.

$$|V1H-V2H| \leqq VT \qquad \text{Formula 2:}$$

$$|V2L-V1L| \leqq VT \qquad \text{Formula 3:}$$

With the first embodiment, the row electrodes 30A at the back substrate 28 side are switched at a time of T2 (ms) at V2H (V) sequentially in the order A1, A2, A3, and A4. Then the switching is made to correspond to the scan, and the voltage of the portions at which the image data are on are made to be V1L (V) with the line electrodes (i.e., data electrodes) 30B of the display substrate 26 side selected in accordance with written image data. At this time, the relation between V2H, V1L and VT is as shown in the following Formula 4.

$$|V2H-V1L| > VT \qquad \text{Formula 4:}$$

When displaying certain selected pixels, such as only the black pixels 1A shown in FIG. 1, a condition is created as shown only in the voltage relations of the pixels 1A. When this occurs, the particles at the back substrate 28 side move to the side of the display substrate 26 and the white display substrate 26 displays black.

With the first embodiment of the present invention, the drive parameters adjusted by the drive parameter changing unit 42 are a pulse voltage V0 and pulse number N0 in the resetting mode, and in the writing mode, the pulse voltage is (V2H−V1L), the pulse width T2, and the pulse number N2, all based on the output of the detection circuit 18 and control unit 20. When the parameters are adjusted, an effect can be obtained such as shown in the following Charts 1 and 2.

CHART 1

| | Reset Mode | | |
|---|---|---|---|
| | Pulse Voltage V0 | Pulse Width T0 | Number of Pulses N0 |
| Charge ↓ | V0 Increased | — | N0 Increased |
| Charge ↑ | V0 Decreased | — | N0 Decreased (Lowest No. is 1) |
| Effect | The greater the V0, the electric field acting on the particles increases, so in a short amount of time, sufficient numbers of particles move and display contrast is obtained (i.e., white density decreases) | | The greater the number of pulses, the amount of remaining particles adhered to the substrate surface in the previous state of display decreases, so the number of particles contributing to display increases; reliability of the display increases (i.e., white density decreases) |

CHART 2

| | Writing Mode | | |
|---|---|---|---|
| | Pulse Voltage (V2H – V1L) | Pulse Width T2 | Number of Pulses N2 |
| Charge ↓ | (V2H – V1L) Increased | T2 Increased | N2 Increased |
| Charge ↑ | (V2H – V1L) Decreased | T2 Decreased | N2 Decreased (Lowest No. is 1) |
| Effect | The larger the potential difference, the greater the electric field acting on the particles becomes, so in a short amount of time, sufficient numbers of particles move and display contrast rises; however, when too large, the particles of non-selected pixels also move (i.e., covering occurs) | The longer the pulse time, the longer electric field acts on the particles, so sufficient particle movement and rise in display contrast are possible even with low voltage; however, if the pulse width is too large, problems such as covering and increased time needed for writing occur | When covering by non-selected pixels occurs, the time high voltage is applied is shortened; the display density can be increased by repeating the application of shortened pulses |

The pulse width T2 can act as a method for changing the pulse width as well as for changing the frequencies, and can also function as a method for changing the duty factor (i.e., that changes the pulse waveforms).

Figure 15A:
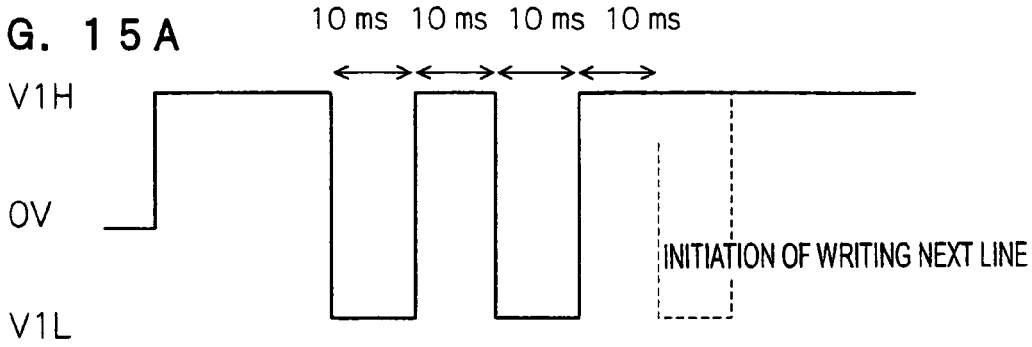
FIG. 15A is the substrate electric potential of the surface electrodes during normal times.
Figure 15B:
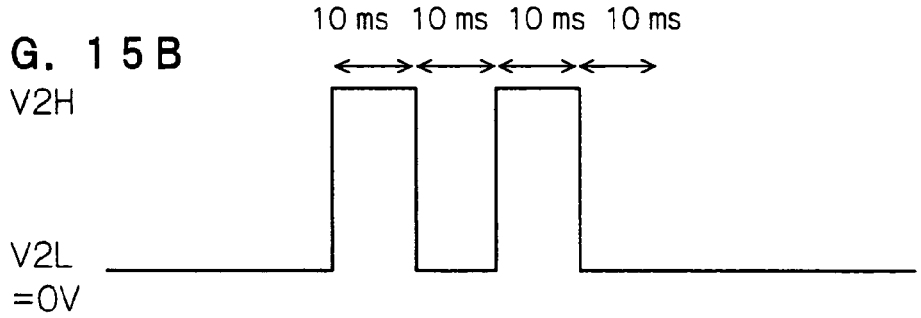
FIG. 15B is the substrate electric potential of the back screen electrodes.

For example, as shown in FIGS. 15A and 15B, usually, two pulses of 10 ms pulses are applied through recess intervals of 10 ms with a 10 ms interval at the end (i.e., with a total of 40 ms and writing frequency of 25 Hz).

When this is changed so that the pulse interval T2 is increased to 12 ms and the pulse interval is also made 12 ms (i.e., with a duty factor 50%) the display density can be raised. However, if on the other hand the writing frequency is made 20.8 Hz, the density deteriorates.

Figure 15C:
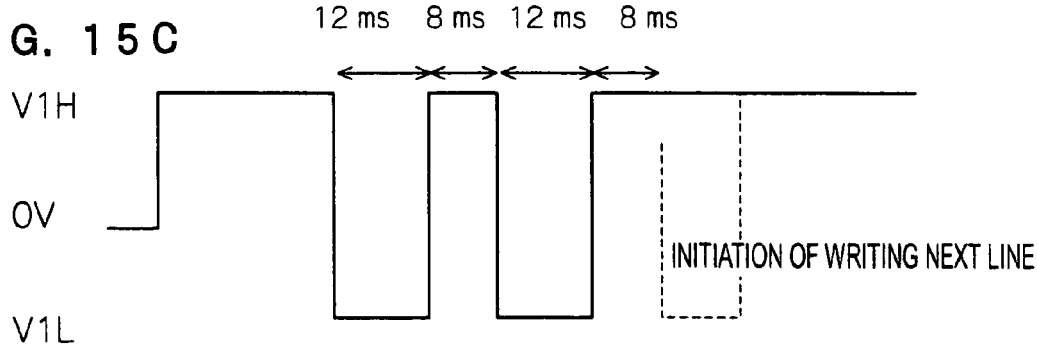
FIG. 15C is the substrate electric potential of the surface electrodes during change.
Figure 15D:
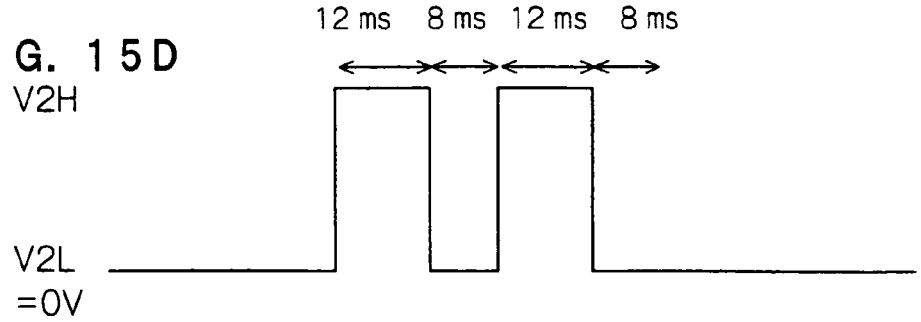
FIG. 15D is the substrate electric potential of the back screen electrodes.

As shown in FIGS. 15C and 15D, when the width T2 of the writing pulse is made to be 12 ms and the width of the recess intervals 8 ms (a total of 40 ms and a duty factor of 60%) the display density can be raised in a state where the writing frequency is maintained at 25 Hz.

Figure 6:
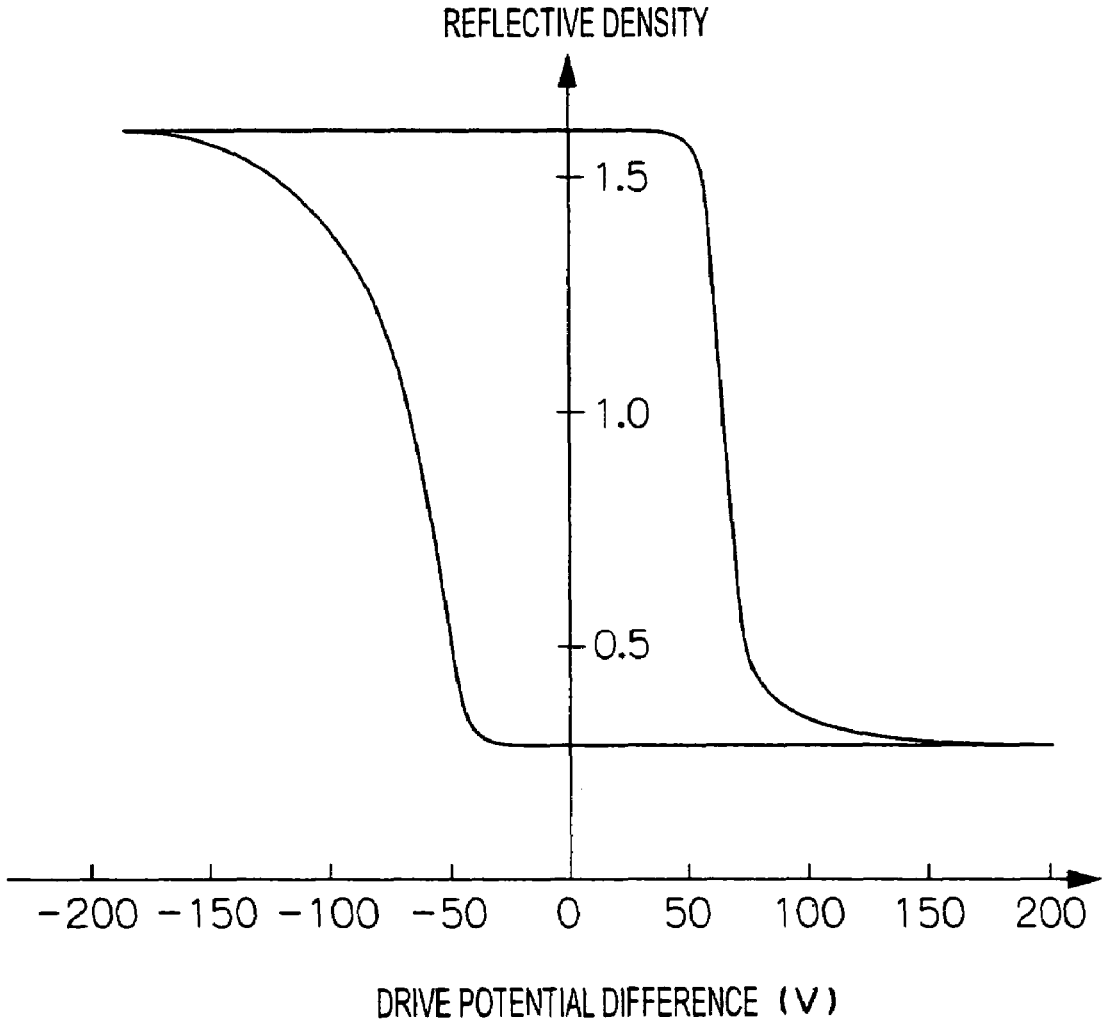
FIG. 6 is a drawing showing the relation between the electric potential difference applied between the electrodes acting against each other in the image display medium and the display density.

Next, the relation between the drive electric potential difference and the display density (i.e., reflective density) is shown in FIG. 6. Here, the drive density difference is a value representing the voltage applied to the row electrodes 30A of the back substrate 28 subtracted from the voltage applied to the line electrodes 30B of the display substrate 26. Further, the display density was measured with a reflective density meter (an X-Rite 404A made by X-Rite Co.) and all values of display density hereafter were measured using the same meter.

Hereafter, a case will be explained where the threshold voltage of the particles is VT (V) (e.g., VT=40V).

The graph shown in FIG. 6 was obtained as described below.

First, all the row electrodes 30A of the back substrate 28 were made constant at 0V and +200V were applied to all the line electrodes 30B of the display substrate 26 so the entire screen of the display substrate 26 was made white. Negative pulse voltage was then applied to all of the line electrodes 30B of the display substrate 26 for 10 msec and the display density was measured with the reflective density meter. After that, another +200V of voltage was applied again to the electrodes of the display substrate 26 for 30 msec, the display screen of the display substrate 26 was made white again, and next, the above-described process was repeated while gradually changing the voltage value of the applied negative pulse voltage.

Similarly, −200V were applied to all the line electrodes 30B of the display substrate 26 so the entire screen of the display substrate 26 displayed black. Positive pulse voltage was then applied to all the line electrodes 30B of the display substrate 26 for 10 msec and the display density was measured with the reflective density meter. After that, another −200V of voltage was applied again to the electrodes of the display substrate 26 for 30 msec, the display screen of the display substrate 26 was made black again, and next, the above-described process was repeated while gradually changing the voltage value of the applied positive pulse voltage.

As can be understood from the content of FIG. 6, when displaying black on the white screen of the display substrate 26, black is not displayed until the difference in electrical potential between the line electrodes 30B of the display substrate 26 and the row electrodes 30A of the back substrate 28 facing them is in the range of +40V. Similarly, when displaying white on the black screen of the display substrate 26, white is not displayed until about −40V.

In this manner, with the combination between the particles and the image display medium 12, it is understood that the VT at which particles move in a state where voltage is applied is 40V.

It should be noted that with the image display medium 12, the voltage at which sufficient display density can be obtained is ±120V (i.e., the contrast ratio of the rate of reflection between black and white is a voltage of 10 or more (reflection density of a state of black display minus the reflection density of a state of white display is equal to or larger than 1, as measured with 404 of X-Rite Co.). Further, it can be determined that if voltage of over 200V is applied, almost all of the particles are moving, from the fact that at over ±200V the density also sufficiently saturates and that even if voltage higher than that is applied, it does not change. Accordingly, when detecting, it is necessary to apply testing voltage of 200V or more. However, it is predicted that when the amount of charge of the particles changes, a larger electric field becomes necessary because the particles move. Accordingly, it is preferable to apply test voltage of ±300V or more, and further preferable to apply test voltage of ±400V or more.

Nonetheless, the VT of the particles changes depending on the type of particles and the structure of the substrate. For this reason, the test voltage applied at the time of detecting should be a higher than the voltage where the density sufficiently saturates, preferably 1.5 times the voltage, and two times or more the amount of voltage is even more preferable.

On the other hand, if too great a voltage is applied, it is possible that excess load will be placed on the power source and that the insulating resistance of the circuits will be damaged. Accordingly, the largest voltage suitable for application is 600V, and it is considered most preferable to contain the voltage somewhere in the range of 500V.

Figure 4:
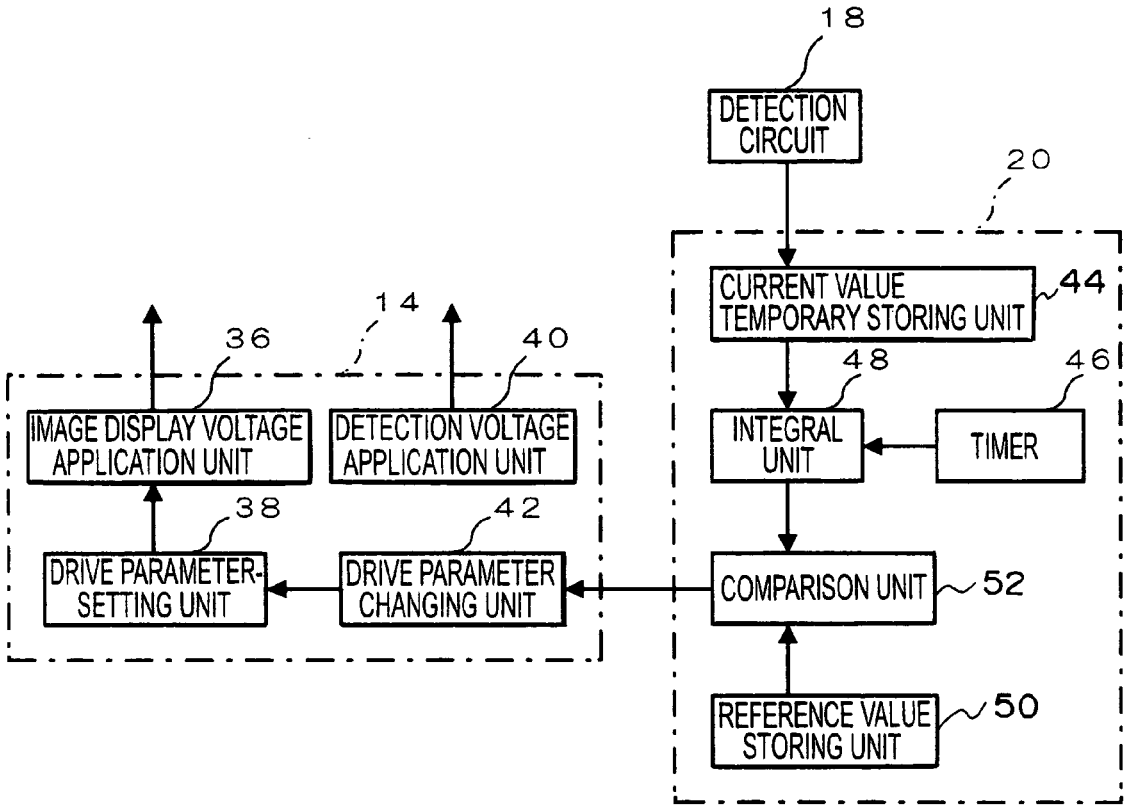
FIG. 4 is a functional structure diagram of the main portions of the image display device according to the first embodiment.

As shown in FIG. 4, the detection circuit 18 is connected to a current value temporary storing unit 44 of the control unit 20. The role of the current value temporary storing unit 44 is to temporarily store the electric current that the detection circuit 18 detected when the testing voltage is applied. The control unit 20 is also provided with a timer 46 that counts time.

The current value temporary storing unit 44 and the timer 46 are connected to an integral unit 48. An integral value is requested with the integral unit 48 based on the value of the electric current temporarily stored with the current value temporary storing unit 44 and the time counted with the timer 46, as shown in the following Formula 5.

$$\text{Integral Value}=\Sigma_j I_j t_j \qquad \text{Formula 5:}$$

$I_j$: Value of electric current at a constant time $t_j$: Constant time

Complementary adjusting regarding $_j$ is performed.

The control unit 20 is also provided with a reference value storing unit 50 that stores a reference value of the integral value.

The integral unit 48 and the reference value storing unit 50 are connected to a comparison unit 52. The comparison unit 52 is designed to compare the integral value stored in the integral unit 48 and the reference value stored in the reference value storing unit 50.

The comparison unit 52 is connected to the drive parameter changing unit 42. If there is a difference between the integral value and the reference value in the aforementioned comparison process, the integral value is outputted to the drive parameter changing unit 42. The drive parameter changing unit 42 changes the drive parameters based on the integral value inputted from the comparison unit 52.

Here, explanations will be made regarding the test voltage applied to the detection voltage application unit 40. With the first embodiment, a trapezoidal wave is employed (i.e., a waveform having a predetermined rise time). Hereafter, the course during which this trapezoidal waveform was applied will be explained.

Figure 7:
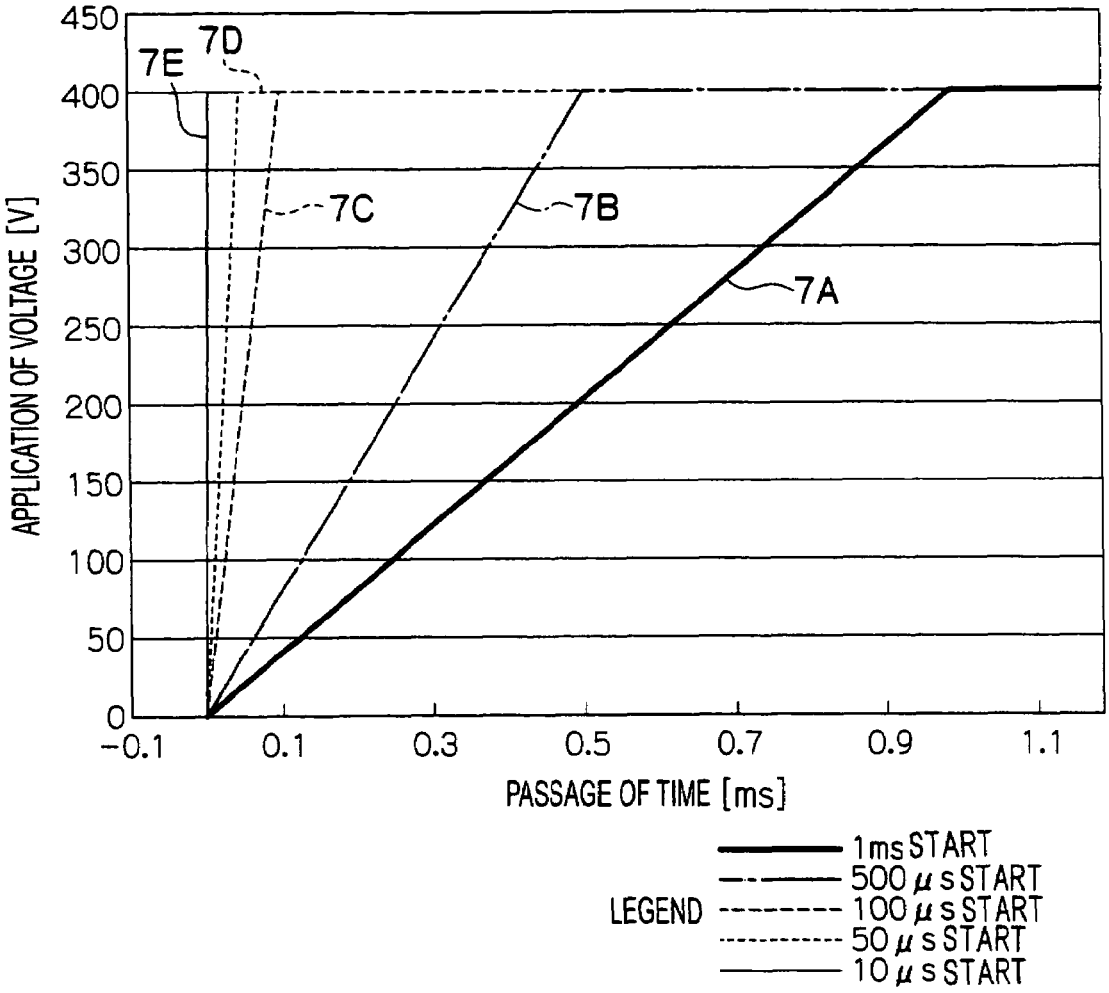
FIG. 7 shows multiple differing voltage waveforms rising at an incline.

In FIG. 7, multiple voltage waveforms are shown where the lines rise at an incline and the time that passes until each reaches a predetermined application voltage varies.

The test voltage is shown with the 7A arrow in FIG. 7 where the passage of time until rising (hereafter, "rise time") is 1 ms; a test voltage where the passage of time for rise time is 500 μs is shown with the 7B arrow in FIG. 7; a test voltage where the passage of time for rise time is 100 μs is shown with the 7C arrow in FIG. 7; a test voltage where the passage of time for rise time is 50 μs is shown with the 7D arrow in FIG. 7; and a test voltage where the passage of time for rise time is 10 μs is shown with the 7E arrow in FIG. 7.

The effective area of the image display medium 12 used is 310 mm×420 mm. The pitch between the electrodes in both the display substrate 26 and the back substrate 28 is 0.5 mm. The line electrodes 30B are patterned into line forms and are ITO electrodes on a glass substrate whose thickness is 1.1 mm in the direction of 420 mm with a distance between electrodes of 30 μm, and the surface is insulated by deep coating polycarbonate made to have a thickness of 1 μm.

The surface is colored black with oxidization treatment after the row electrodes 30A are patterned in line forms in the 310 mm direction with copper electrode substrates. After dry film is layered at a height of 150 μm, portions that are left to act as spacers are made 75 μm, and the shape of the cells that surround the spacers are processed with photolithography to become 1×4 mm.

Then the particles are enclosed inside the cells and an adhesive that can thermally plasticize is coated on the spacers, after which the top and bottom substrates are stuck to each other.

Figure 8:
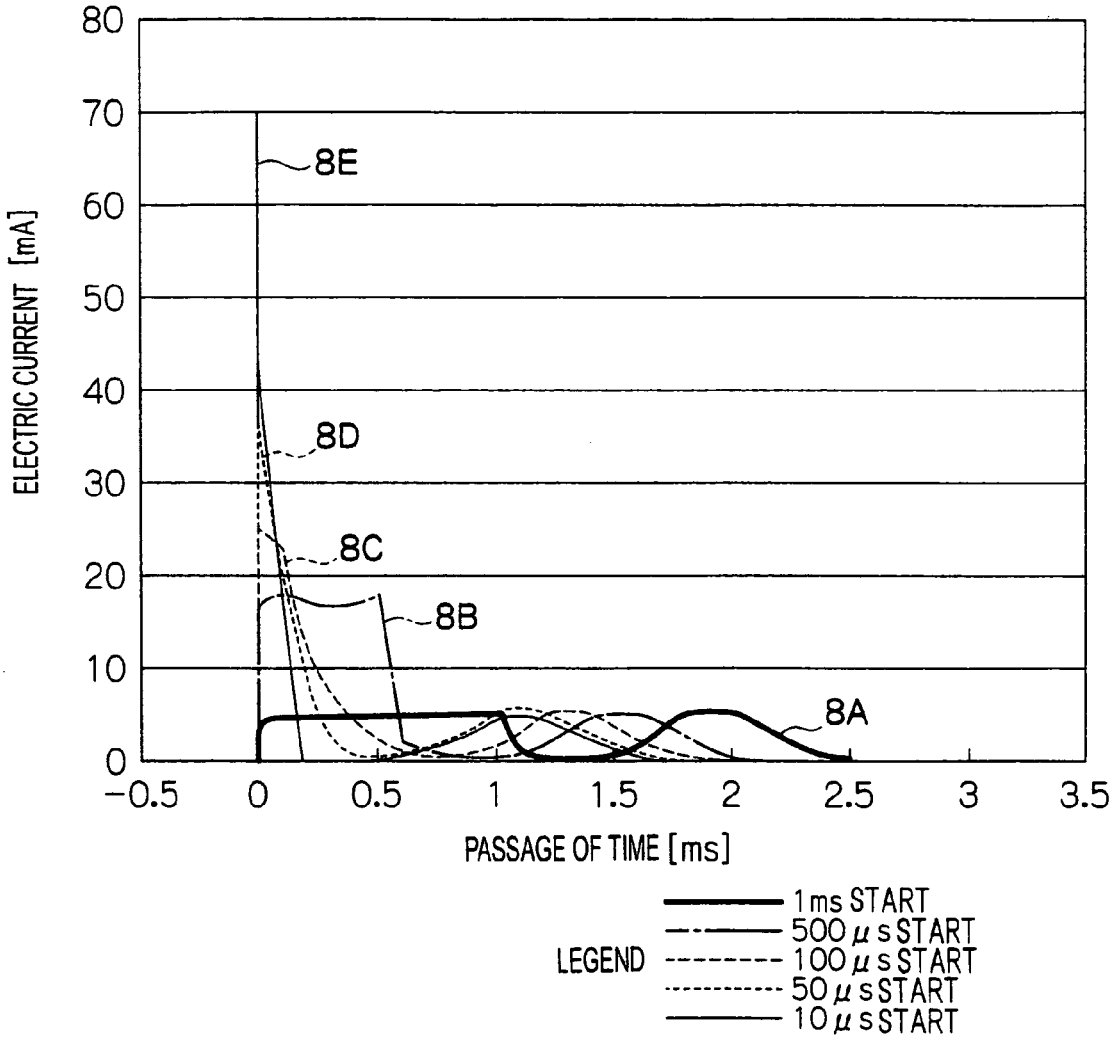
FIG. 8 shows the electric current values when the voltage waveforms of FIG. 7 are applied.

Next, predicted values of the waveforms of the electrical current are shown in FIG. 8, in a case where a test voltage such as that shown in FIG. 7 is applied.

When detecting the electric current, the connection is changed so that all of the row electrodes 30B at the display substrate 26 side are made the same electric potential once and all of the line electrodes 30A at the back substrate 28 side are made the same electric potential. The line electrodes 30A at the back substrate 28 side are connected to the ground side of the drive power source 14 via the detection circuit 18 and when high test voltage is applied, the electric current flowing to the ground side of the drive power source 14 was detected.

The predicted value in a case where the test voltage shown with the 7A arrow in FIG. 7 is applied is shown with the 8A arrow of FIG. 8. The predicted value in a case where the test voltage shown with the 7B arrow in FIG. 7 is applied is show with the 8B arrow of FIG. 8. The predicted value in a case where the test voltage shown with the 7C arrow in FIG. 7 is applied is shown with the 8C arrow of FIG. 8. The predicted value in a case where the test voltage shown with the 7D arrow in FIG. 7 is applied is shown with the 8D arrow of FIG. 8. The predicted value in a case where the test voltage shown with the 7E arrow in FIG. 7 is applied is shown with the 8E arrow of FIG. 8. It can be understood that when the rising time of the test voltage lengthens, the incoming (i.e., inrush) voltage lessens.

When the rise time was at 100 μs, 50 μs, and 10 μs, the detected electric current became larger than 20 mA, and it was necessary to increase the range of the electric current to the maximum.

In contrast, when the rise time was at 500 μs or more, the value of the electric current at the inclined portions became less than 20 mA. Further, when the rise time was at 1 ms or more, the value of the electric current at the inclined portions became less than 10 mA.

In short, it can be understood that the detection accuracy can be improved by lengthening the rise time.

It is notable that when changes in the amount of charge caused by deterioration of the particles due to passage of time or changes from the drive history or the surrounding temperature were detected with the amount of electric current, that change was less than 0.1 mA. Accordingly, it is necessary to decrease the incoming electric current in order to increase the accuracy of detection.

Incoming current is generated by the electric field between the substrates of the display substrate 26 and back substrate 28 so it is only necessary to make this a mechanism that approaches a constant value when increasing the application voltage by making the start of the application of test voltage incline. It is generally known that when applying voltage waveforms that increase the line form of $\alpha V$ at units of time at a condenser component C in the equivalent circuit value of resistance R with $E=\alpha t$, the voltage at both ends of the condenser becomes asymptotic towards $CR\alpha$.

In this manner, it is preferable that the rising time be 0.5 ms or greater, and further preferable that it be 1 ms or more. If the rising time is made to be 2 ms or more, a condition occurs where the electrical field has not sufficiently risen, even if the particles begin moving, and since this affects the movement of the particles, it is preferable that the time be less than 2 ms.

The above example is one where the distance between substrates with the display substrate 26 and the back substrate 28 is 150 μm. The incoming current becomes even greater the closer the substrates become, whereas the electric current accompanying movement of the particles hardly changes, so for this reason it is necessary to suppress the incoming current.

In order to obtain an electric current value such as that shown with the 8A arrow in FIG. 8 with the first embodiment, the detection voltage application unit 40 applies test voltage that has a predetermined start time and generates a voltage value that successively and gradually rises with generated trapezoidal waveforms, such as shown with the 7A arrow in FIG. 7.

Next, the operation of the image display device 10 according to the first embodiment will be explained.

Figure 9:
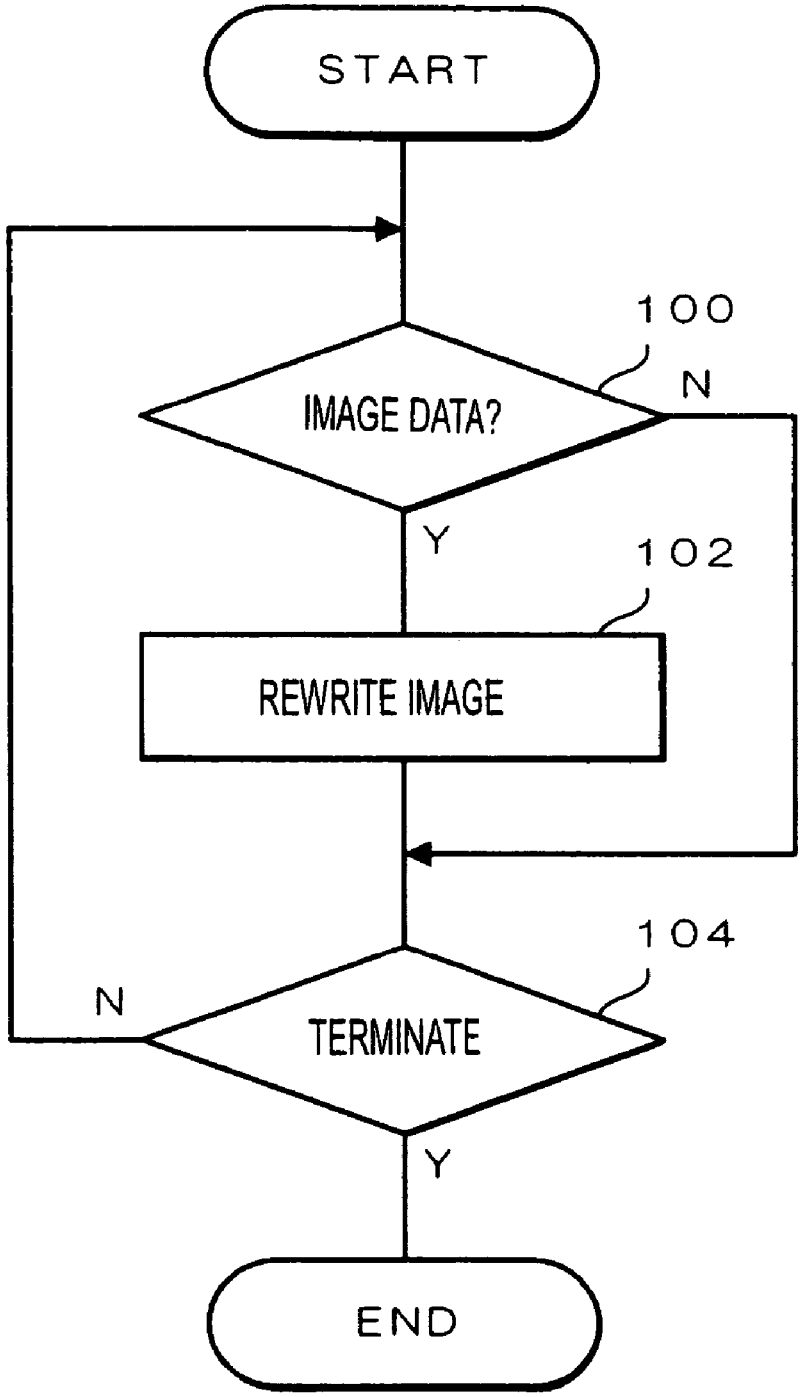
FIG. 9 is a flowchart of the image alteration according to the first embodiment.

First, the flow of image writing will be explained while following the flowchart of FIG. 9.

At step 100, it is determined whether there is image data. When affirmative, the routine moves to step 102, and when determined negative at step 100, the routine moves to step 104.

Rewriting of the image displayed on the image display medium 12 is performed at the 102.

At step 104, it is determined whether the flow is completed. When affirmative, the flow is terminated. When a negative determination is made at step 104, the routine returns to step 100.

Incidentally, the image display device 10 of the first embodiment is provided with a function that adjusts the voltage applied to the display pixels based on the physical amount of electricity detected using the test voltage in place of the image display voltage regularly applied. The operation of portions relating to this function will be explained in detail using the flowcharts of FIGS. 10 and 11.

Figure 10:
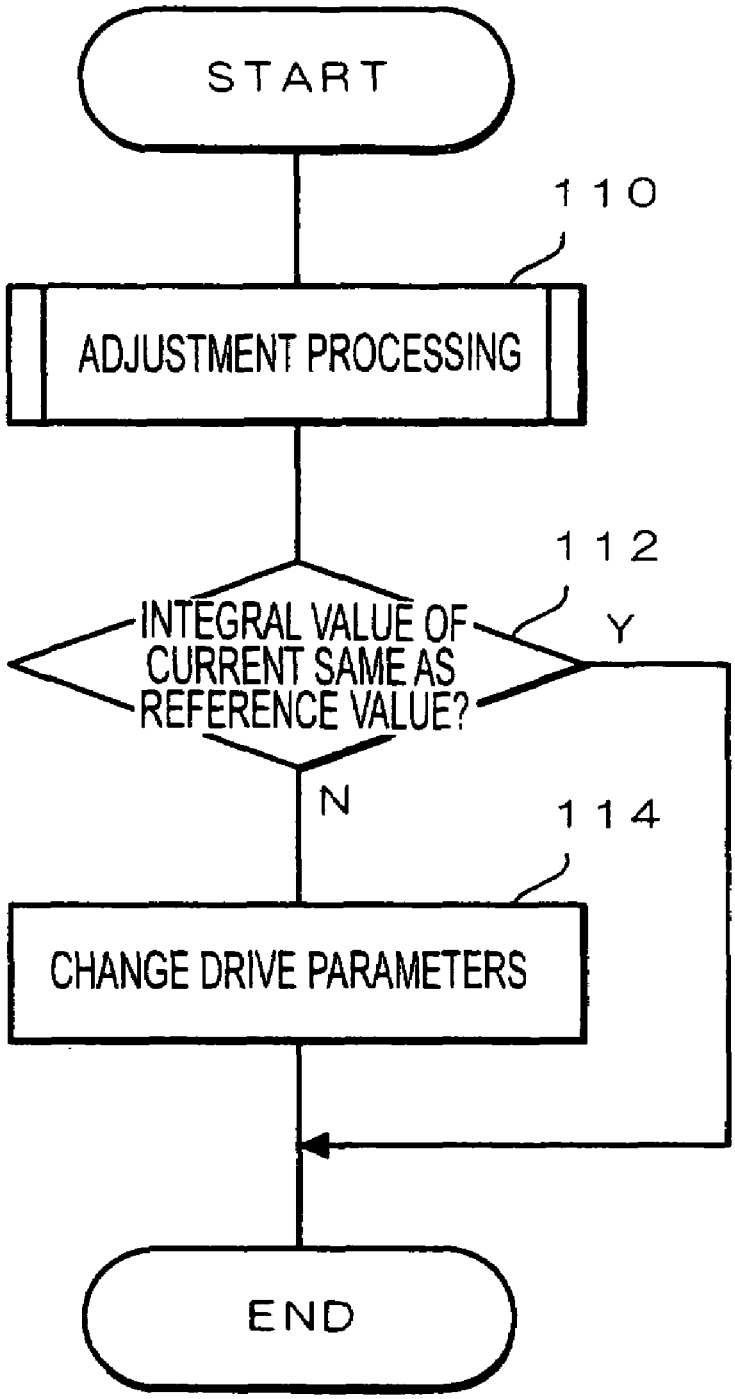
FIG. 10 is a flowchart of the drive parameter change according to the first embodiment.

The flow shown in FIG. 10 is initiated by an operation command inputted by a user.

Figure 11:
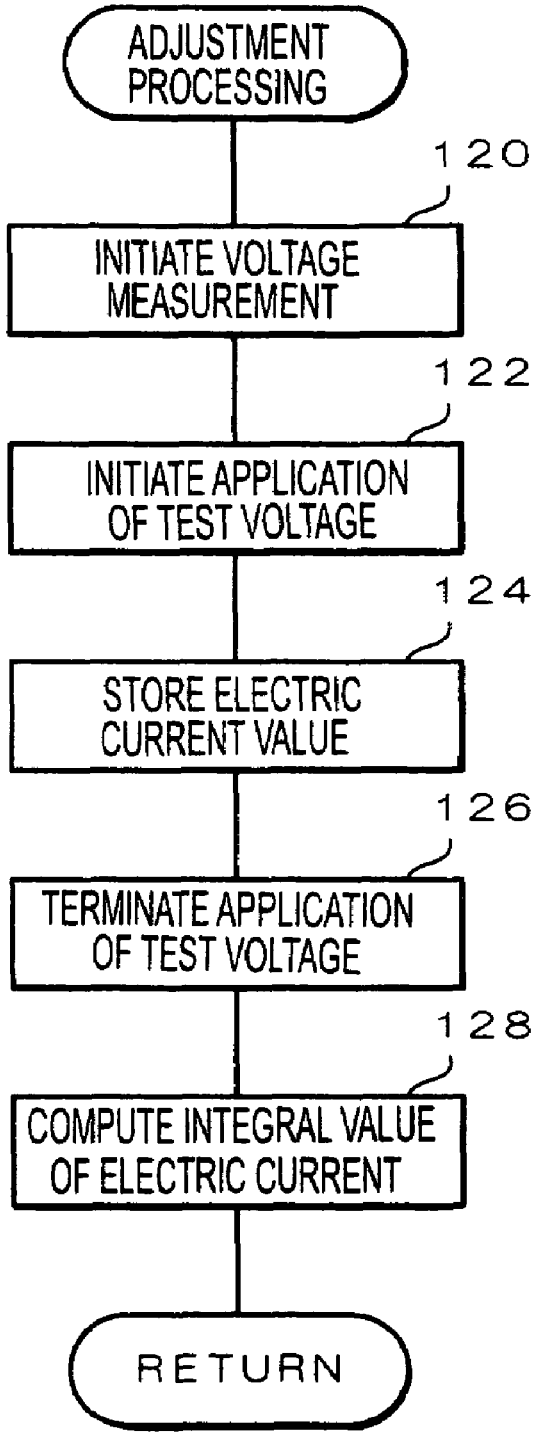
FIG. 11 is a flowchart of adjustment processing according to the first embodiment.

First, at step 110, the adjustment processing shown in FIG. 11 is performed.

Next, at step 112, the comparison unit 52 determines whether the integral value of the electric current is the same as the reference value of the reference value storing unit 50. When these are the same and an affirmative determination is made, the flow terminates, and when negative at step 112, the routine moves to step 114.

At step 114, change of the drive parameters is performed.

It should be noted that this flow can also be a mechanism that enters an adjustment mode at a predetermined timing consecutively decided in advance, such as when the power is turned on.

Next, the adjustment processing will be explained in detail using FIG. 11.

First, at step 120, voltage measurement is initiated with the detection circuit 18.

Prior to detection, a white or black color was displayed on the whole screen due to the resetting mode of the displayed image, and the electric current waveforms when the particles were moved from black to white or white to black were measured.

Next, at step 122, application of test voltage is initiated with the detection voltage application unit 40.

At step 124, an electric current value is calculated from the measured voltage value and this voltage value during a set constant time is stored. The electric current value is stored with every passage of this constant time and the memory keeps accumulating.

Next, at step 126, the application of test voltage with the detection voltage application unit 40 is completed.

Next, at step 128, the integral value of the electric current is calculated with the integral unit 48 in accordance with the above Formula 5.

When the entire surface of the display area is switched from white (maximum rate of reflection) to black (minimum rate of reflection), during detection of the integral value of the electric current, the amount of electric current is large and changes in the charge of the entire display substrate 26 are detected.

On the other hand, when a portion of the display area is switched from white (maximum rate of reflection) to black (minimum rate of reflection), the condition of partial charge changes and the state of deterioration can be detected and improvement of equality can be performed.

Further, with the calculation of the integral value of the electric current, switching of the display from white to black is repeated multiple times on the entire screen of the display area, whereby adverse effects on the display history just prior can be reduced and is thus preferable. For example, differences between the portions where black images were not written and portions where white images were frequently written, in a state prior to the application of test voltage can be reduced.

In this manner, with the first embodiment, highly accurate detection can be performed while the image display device can prevent changes in the display density and contrast due to deterioration caused by repeated displaying over long periods of time and changes in environment. Further, the burden placed on the power source is alleviated.

Second Embodiment

Hereafter, the second embodiment of the present invention will be explained. Components in this second embodiment that are the same as those of the first embodiment have been given the same numbers, and explanations on those portions have been omitted.

With the second embodiment, voltage application is performed three times and measurement twice, whereby subtraction of the integral value of the electric current flowing due to the electric field between the substrates is performed. This acts as a mechanism that performs change of the drive parameters.

If all that is required is the detection of the amount of change of the components of the electric current value due to the movement of the particles, it is not necessary to subtract the integral value of the electric current flowing due to the electric field between the substrates, as is performed with the second embodiment. All that needs to be done is a comparison with the integral value set at resetting so as to determine whether any changes have occurred.

Nonetheless, there are cases where changes are generated in the integral value of the electric current flowing due to the electric field between the substrates due to measurement changes caused by the temperature. In this type of case as well, detection of components of accurate particle movement can be performed by detecting the integral value of the electric current at the time of particle movement, as in the second embodiment (i.e., at the time of the second application of voltage). After that, it is only necessary to apply the same drive voltage, detect the integral value of the electric current flowing due to the static electricity capacity (i.e., at the time of the third application of voltage); and make the difference between these the integral value of the electric current at the time of particle movement. At the time of second application of voltage, particles of one color have already moved to the one side of a substrate so particle movement is not generated with the third application of voltage.

Figure 12:
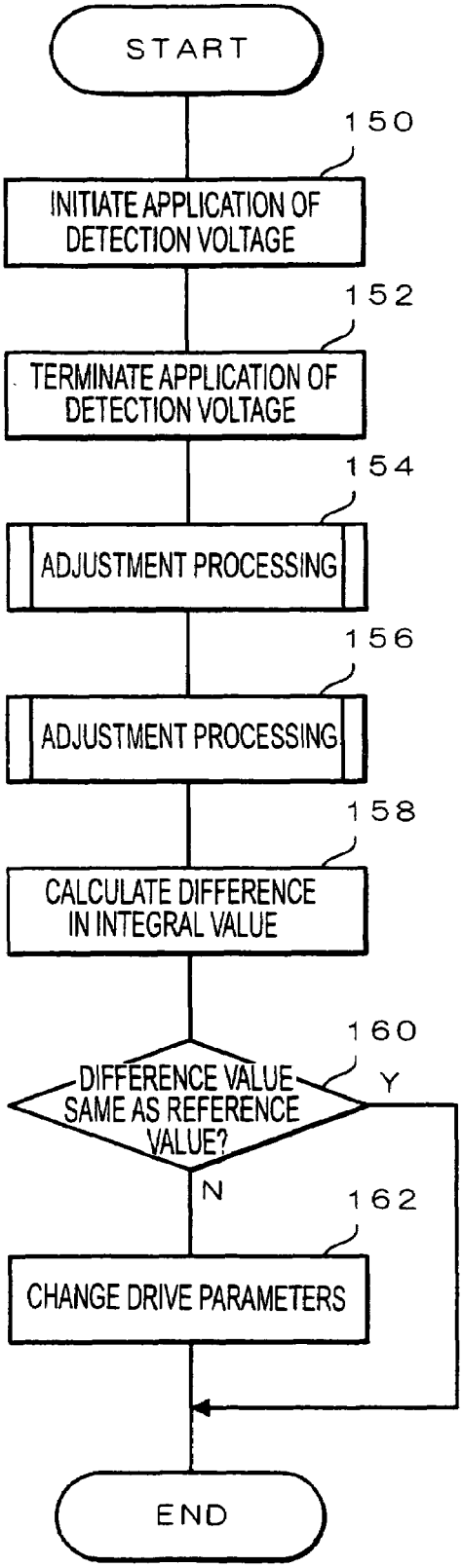
FIG. 12 is a flowchart of the drive parameter change according to the second embodiment.

Next, the operation of portions relating to the second embodiment will be explained in detail with the flowchart of FIG. 12.

First, voltage application from the drive power source 14 is initiated at step 150.

Figure 13A:
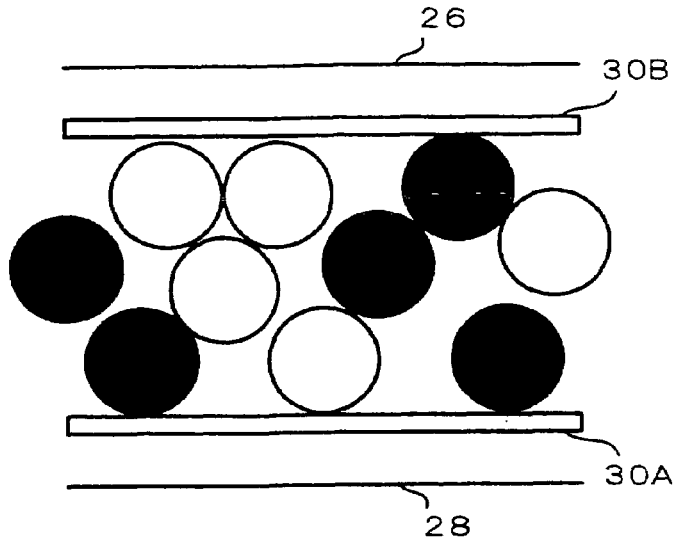
FIG. 13A shows a state where the particles are positioned in a disorderly fashion between the substrates.

As shown in FIG. 13A, prior to the application of voltage, the particles are positioned as is on the display substrate 26 displaying an arbitrary image (or in an arbitrary state). Then, with the application of voltage, the white particles 34 are pulled towards the line electrodes 30B and the black particles 32 are pulled towards the row electrodes 30A, as shown in FIG. 13B.

Figure 13B:
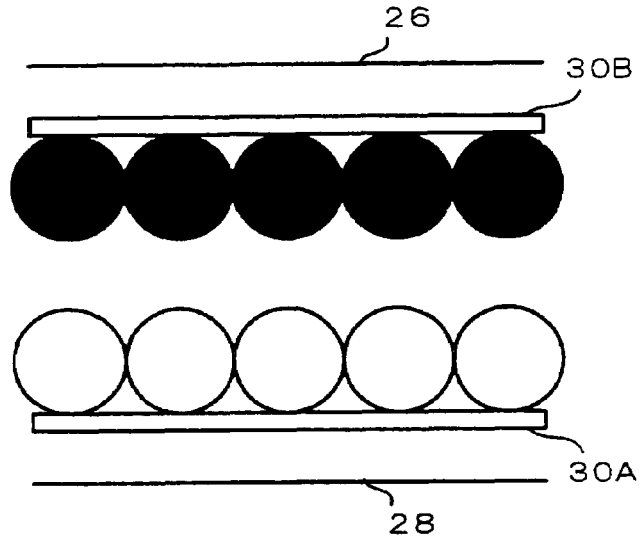
FIG. 13B shows a state where the particles are positioned in an orderly fashion between the substrates.

After the particles are in the state shown in FIG. 13B, the routine moves to step 152. At step 154, the application of voltage from the drive power source 14 is terminated.

Figure 13C:
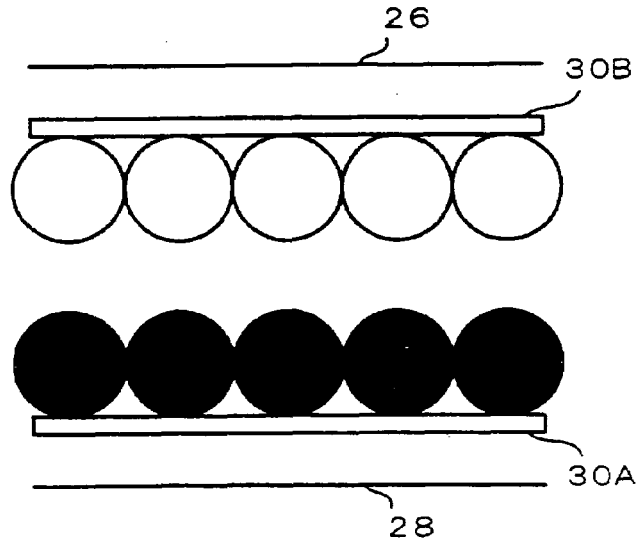
FIG. 13C shows a state where the color has been reversed from the state shown in FIG. 13B.

At step 154, the above-described adjustment processing is performed, with which change from the state shown in FIG. 13B to the stat shown in FIG. 13C is performed.

At step 156, the above-described adjustment processing is performed, with which processing is performed where the particles, as they are in the state of FIG. 13C, are not made to move.

Next, at step 158, the difference between the integral value requested with the processing at step 154 and the integral value requested with the processing at step 156 is sought.

Next, at step 160, determination is made as to whether the value of this difference is the same as a reference value. When these are the same, an affirmative determination is made and the flow is completed. When a negative determination is made at step 160, the routine moves to step 162.

Change of the drive parameters is performed at step 162.

Hence, with the second embodiment, detection of the components of particle movement can be detected with further accuracy.

It should be noted that a voltage meter was used in the first and second embodiments, however, these can be configured such that the electric current is measured with a direct current meter. In this case, since measurement of the resistance value becomes unnecessary, a simpler configuration can be achieved and it is not necessary to measure the voltage. Further, the present device can be configured as a mechanism that measures electric power.

EXAMPLES

Hereafter, the experiments performed with the first and second embodiments will be explained.

Example 1

The image display device of the present invention was made in the following manner.

The display substrate 26 was made by sputtering an ITO film on a component made from transparent glass having a thickness of 1 mm. This is etched with a preset pattern and multiple row electrodes 30B were formed. A solution that dissolves a polycarbonate resin 3 weight unit relative to a 97 weight unit on these line electrodes 30B is deep-coated, after which this is dried, whereby an insulating film made from a polycarbonate film having a thickness of 2 μm is formed thereon.

For the back substrate 28, which is made from a glass epoxy resin substrate that is 0.2 mm thick, a copper film is stuck thereto, and this is etched at a preset pattern thus forming multiple row electrodes 30A. The surface is dyed black with oxidization treatment and after layering a dry film such that it has a height of 150 μm, after which photolithographic processing is performed so that portions remain that act as spacers having widths of 75 μm and the forms of cells surrounding the spacers are 1 mm by 4 mm. After that, a solution that dissolves a polycarbonate resin 3 weight unit relative to a 97 weight unit on these row electrodes 30A is deep-coated and dried, whereby an insulating film made from a polycarbonate film having a thickness of 2 μm is formed thereon. Further, an adhesive that can thermally plasticize is printed on the spacers with a stainless steel mesh, and then the substrate is completed by drying for 30 minutes at 150° C.

The white particles 34 are made by attaching titania microparticles with a weight unit of 0.4 that have undergone isopropyl trimethoxysilane treatment to the exterior of spherical microparticles with weight portions of 100 of cross-linked polymethylmethacrylate having oxidized titanium particles whose average volume diameter is 13 μm.

Spherical microparticles of cross-linked polymethylmethacrylate having carbon particles whose average volume diameter is 13 μm are used for the black particles 32.

Next, the white particles 34 and the black particles 32 are mixed at a one to one weight ratio, and are shaken into depressions partitioned with spacers on the back substrate 28 through a stainless steel screen. And white particles 34 and black particles 32 adhered to the upper surfaces of the spacers are removed with a blade made of silicon rubber. The display substrate 26 is placed in a predetermined position so as to overlap with the back substrate 28, and these are heat-pressure bonded with 100° C. and joined.

Flexible print substrates are heat-pressure bonded to the line electrodes 30B of the display substrate 26 and the row electrodes 30A of the back substrate 28, whereby these are connected, and after electrically connecting these to the corresponding line drive circuit 16B and the row drive circuit 16A, first, resetting voltage of ±200V at 400 Hz is sequentially applied to each of the line electrodes 30B and the row electrodes 30A for five minutes. Sufficient friction charge is imparted to the particles, which are evenly distributed on the surface of the display substrates, whereby the image display device was made.

The measured VT of this image display device was VT=50. Test voltage achieving an almost straight line up to 300V was applied within the time of 1 ms. When this is done, the integral value of the electric current caused by the static electric capacity between the substrates is almost exactly the same as the value caused by particle movement.

In contrast, when starting test voltage with conventional rectangular waves were applied close to 100 μs at 300V, the integral value of the electric current flowing due to the electric field between the substrates became over ten times that of the components caused by particle movement, so the accuracy for detecting changes in the electric current value that could be detected was low.

Figure 14:
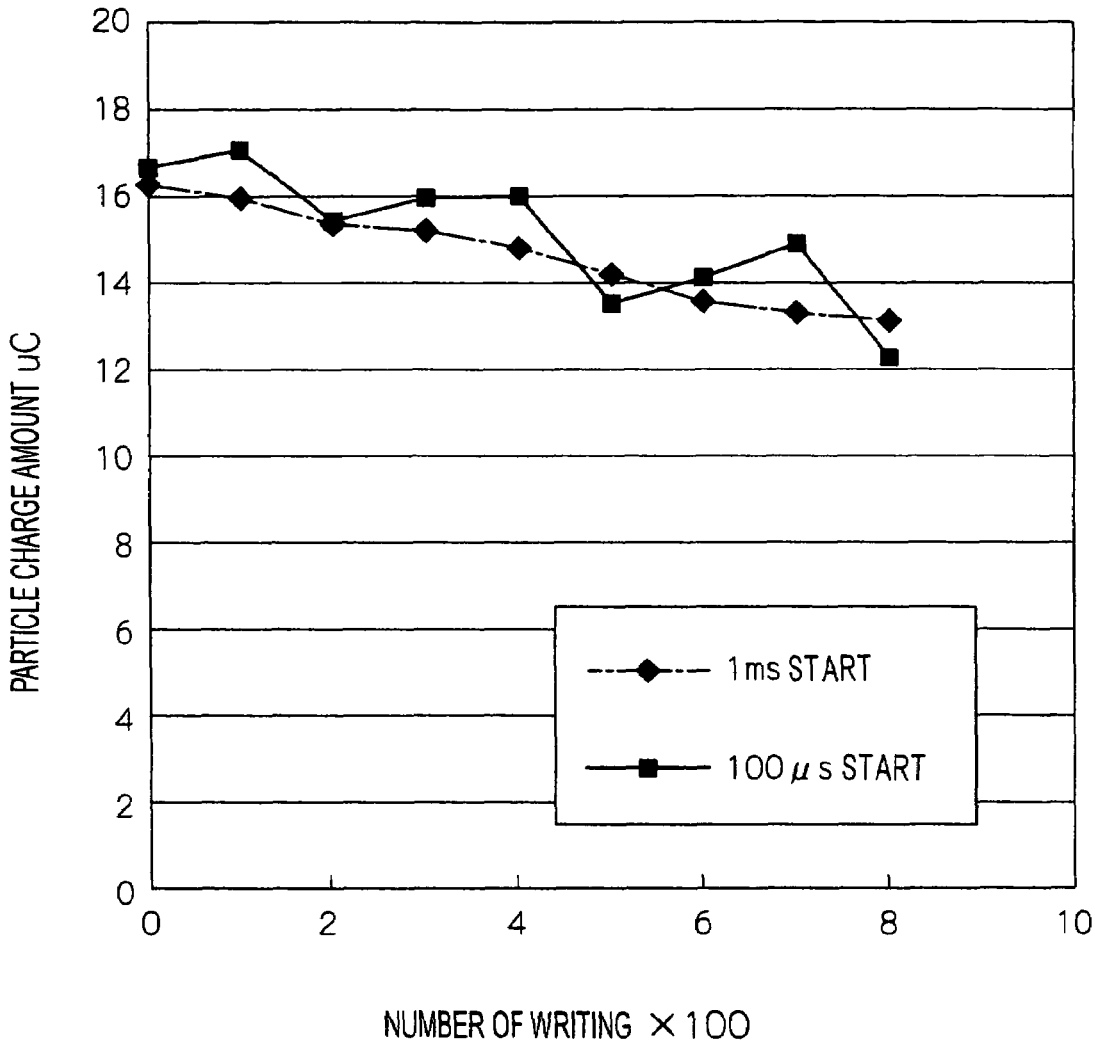
FIG. 14 is a graph showing changes in the amount of particle charge of a character written one hundred times in the first Example.

FIG. 14 shows the changes in the amount of electric current detected at all the writings performed 100 times when continuous image display was performed on the image display medium 12 with the drive parameters set at regular time as shown in Chart 2 below.

When executing, for example, the 300th detection, the amount of electric load calculated from the value detected at close to 100 μs with the conventional rectangular waves, it is difficult to compare with the value at start time to determine if there has been a change, due to noise. In the case of start waveforms of 1 ms, the noise relative to the measured waveforms is little so detection of changes in charge of the particles could be performed with good accuracy.

CHART 3

| | Reset Mode | | | Writing Mode | | | | |
|---|---|---|---|---|---|---|---|---|
| | Pulse Voltage V0 | Pulse Width T0 | Pulse No. N0 | Pulse Voltage (V2H − V1L) | Pulse Width T2 | Pulse No. N2 | (A) * | (B) ** |
| Start Time | 200 V | 0.5 S (1 Hz) | Both polarities (+200, −200, +200, −200, +200) | 120 V (V1H = 40 V, V1L = −40 V, V2H = 80 V, V2L = 0 V) | 10 ms | 2 | W 0.45 B 1.52 | W 0.45 B 1.52 |
| $100^{th}$ | 210 V | 0.5 S (1 Hz) | 5 times | 135 V (V1H = 45 V, V1L = −45 V, V2H = 90 V, V2L = 0 V) | 10 ms | 2 | W 0.46 B 1.49 | W 0.45 B 1.51 |
| $200^{th}$ | 210 V | 0.5 S (1 Hz) | N0 Decreased (Min. 1) | 135 V (V1H = 45 V, V1L = −45 V, V2H = 90 V, V2L = 0 V) | 12 ms | 2 | W 0.47 B 1.48 | W 0.45 B 1.50 |

(A) * Display density based on detection of voltage with 100 μs start
(B) ** Display density after correction based on detection with present Example In Example 1 of the present invention, a result was obtained where the effect was that there was almost no change in display density between resetting and after correction, and display deterioration was not observed by the user.

With conventional test voltage, detection accuracy was insufficient and when it was determined that correction was not necessary, the display condition was made the same as prior to the changes in parameters. Then, when the display was repeated with this condition unchanged, a result was obtained where deterioration was evident, especially in the density of a black display.

Example 2

With Example 2 of the present invention, the application of test voltage of Example 1, the integral value of the electric current caused by particle movement was sought with the difference subtracted from the portion of static electricity capacity of the substrates by applying the third voltage as in the second embodiment. In this Example 2, the integral amount of the electric current caused by particle movement in the resetting state was stored with the reference value storing unit 50. It was found that there were no environmental influences, when a comparison was performed with the comparison unit 52 regarding the detection amount of the electric current in an environment where the room temperature was 10° C.-30° C. Noise was thus reduced even lower than in Example 1 and the detection accuracy improved.

In this manner, with the voltage application of Example 2, the detection accuracy can be increased. When adjustment of drive pulses are performed based on this detection value, the occurrence of display image deterioration can be prevented.

As shown in the above explanations, the present invention provides an image display device that can prevent changes in the image density and contrast due to deterioration caused by repeated displaying over long periods of time and changes in environment (e.g., temperature, moisture, and atmospheric pressure) by employing accurate electric current detection. Furthermore, the burden placed on the power source can also be alleviated.

With the first invention, a test application unit applies test voltage set to be at least higher than the image display voltage and this is executed, for example, at timing other than the timing of image display. A detection unit detects the electrical physical amount of the electrodes when the test voltage is applied by the test application unit.

Then the status of the voltage value at the time an image is displayed is judged (by a determination unit) based on the detection result of the detection unit. Here, the test voltage by the test application unit is made to have a predetermined start time.

Normally, when voltage (with rectangular waves) is applied to the electrodes, extremely large electric current flows, however, as in the first invention, when the unit is made to have a start time and test voltage is applied such that it gradually increases, the peak value of the value of the flowing electric current can be lowered. In other words, unnecessary electric current such as incoming current can be reduced. Detection of the physical amount of electricity when test voltage is applied to the electrodes can be performed with good precision and the burden of the power source supplying the test voltage can be lessened.

Accordingly, with the first invention, changes in the image density and contrast due to deterioration caused by repeated displaying over long periods of time and changes in environment (e.g., temperature, moisture, and atmospheric pressure) can be prevented by employing accurate electric current detection. Furthermore, the burden placed on the power source can also be alleviated.

The electrical physical amount is determined by at least one of the electric current and the voltage. When detecting this amount, it is preferable to detect minute changes in electric current that accompanies displaying an image, however, the amount of charge can also be measured. Further, the voltage at both ends of resistance connected to straight rows of circuits through which current is flowing can also be measured. The effect is the same with either method.

The first aspect of invention includes a feature that the waveforms of the test voltage due to the setting of the start time is a trapezoidal waveform where the voltage value gradually and sequentially rises.

Further, the first aspect of invention includes a feature that it comprises an adjustment unit that adjusts the image display voltage applied between the pair of electrodes based on the physical amount of electricity detected with the detection unit when the determination unit has judged that the status of the image display voltage is bad.

The first aspect of invention includes another feature that the adjustment unit performs adjustment of waveforms including at least one of pulse waves and amplitude of the applied image display voltage.

With the second aspect of invention, unnecessary electric current such as incoming current can be negated so, as with the first invention, changes in the image density and contrast due to deterioration caused by repeated displaying over long periods of time and changes in environment (e.g., temperature, moisture, and atmospheric pressure) can be prevented by employing accurate electric current detection.

The second aspect of invention includes a feature that the first application of voltage and the second application of voltage have predetermined starting times, and the voltage value is adjusted to a trapezoidal waveform where the voltage value gradually and sequentially rises.

Accordingly, incoming current can be alleviated and the burden placed on the power source reduced.

As explained above, the image display device and method therefor provide an excellent effect in that changes in the image density and contrast due to deterioration caused by repeated displaying over long periods of time and changes in environment (e.g., temperature, moisture, and atmospheric pressure) can be prevented by employing accurate electric current detection.

In addition to the above effect, the image display device and method therefor provide an excellent effect in that the burden placed on the power source can be reduced.

What is claimed is:

1. An image display device comprising colored particles enclosed between a pair of electrodes, at least one of which is a transparent electrode, the image display device moving the colored particles by applying predetermined image display voltage based on image data and displaying an image at the transparent electrode side, the image display device comprising:

a test voltage application unit that applies a test voltage set to be at least greater than the image display voltage;

a detection unit that detects the physical amount of electricity between the pair of electrodes when the test voltage is applied with the test voltage application unit; and a determination unit that judges a status of the image display voltage for displaying an image based on the detection result of the detection unit, wherein a predetermined start time is set at the test voltage by the test voltage application unit.

2. The image display device of claim 1, wherein a waveform of the test voltage by the setting of the start time is a trapezoidal waveform where the voltage value gradually and sequentially rises.

3. The image display device of claim 1, further comprising an adjustment unit that adjusts the image display voltage applied between the pair of electrodes based on the physical amount of electricity detected with the detection unit when the determination unit has judged that the status of the image display voltage is bad.

4. The image display device of claim 1, wherein the adjustment unit performs adjustment of waveforms including at least one of pulse waves and the amplitude of the applied image display voltage.

5. An image display method for an image display device that comprises colored particles enclosed between a pair of electrodes, at least one of which is a transparent electrode, the image display device moving the colored particles by applying a predetermined image display voltage based on image data and displaying an image at the transparent electrode side, the image display method comprising:

applying a preliminary test voltage that moves the colored particles towards at least one of the electrodes, applying a first test voltage that moves the colored particles moving towards one electrode to the other electrode, and applying a second test voltage that maintains the colored particles which have moved toward the other electrode;

detecting the physical amount of electricity between the pair of electrodes when the first test voltage is applied and the physical amount of electricity between the pair of electrodes when the second test voltage is applied; and calculating the difference between the physical amount of electricity between the pair of electrodes when the first test voltage is applied and the physical amount of electricity between the pair of electrodes when the second test voltage is applied, wherein a judgment is made on a status of the image display voltage for displaying an image based on the calculation result.

6. The image display method of claim 5, wherein the first application of voltage and the second application of voltage have predetermined starting times, and the voltage value is adjusted to a trapezoidal waveform where the voltage value gradually and sequentially rises.

7. The image display device of claim 1, further comprising a matrix driving system that sequentially applies image writing voltages to electrode rows.

8. The image display device of claim 1, further comprising an integral unit that calculates and stores an integral value based on the values of a temporarily stored electric current and time.

9. The image display device of claim 8, further comprising a reference value storage unit that stores a reference value of the integral value.

10. The image display device of claim 9, further comprising a comparison unit that compares the integral value stored in the integral unit and the reference value of the integral value stored in the reference value storage unit.

11. The image display device of claim 10, further comprising a drive parameter changing unit that changes drive parameters based on an integral value inputted from the comparison unit.

* * * * *